US005901626A

United States Patent [19]

Temburg

[11] Patent Number: 5,901,626

[45] Date of Patent: May 11, 1999

[54] APPARATUS FOR DETECTING METAL TIES IN FIBER BALES

[75] Inventor: Josef Temburg, Jüchen, Germany

[73] Assignee: Trützschler GmbH & Co. KG, Mönchengladbach, Germany

[21] Appl. No.: 08/657,108

[22] Filed: Jun. 3, 1996

[30] Foreign Application Priority Data

Jun. 2, 1995 [DE] Germany ..... 195 20 247

[51] Int. Cl.[6] ..... B26D 5/00

[52] U.S. Cl. ..... 83/364; 83/370; 83/151; 83/426; 83/909

[58] Field of Search ..... 83/909, 370, 935, 83/425, 426, 428, 151, 364

[56] References Cited

U.S. PATENT DOCUMENTS

| | | | |
|---|---|---|---|
| 4,414,730 | 11/1983 | Ohmura et al. | 83/909 |
| 4,722,443 | 2/1988 | Maruyama et al. | 83/909 |
| 4,809,573 | 3/1989 | Welch | 83/364 |
| 4,838,751 | 6/1989 | Hanaya et al. . | |
| 4,878,287 | 11/1989 | Hergeth . | |
| 4,929,141 | 5/1990 | Keesey et al. | 83/909 |
| 5,074,739 | 12/1991 | Takahashi et al. | 83/909 |
| 5,090,573 | 2/1992 | Takahashi et al. | 83/909 |
| 5,156,516 | 10/1992 | Boisseau | 83/909 |
| 5,179,878 | 1/1993 | Kranefeld et al. | 83/909 |
| 5,199,841 | 4/1993 | Von Gehlen | 83/909 |
| 5,216,797 | 6/1993 | Hall | 83/909 |
| 5,286,317 | 2/1994 | Treat et al. | 83/370 |
| 5,406,690 | 4/1995 | Neilsen et al. | 83/909 |

FOREIGN PATENT DOCUMENTS

| | | |
|---|---|---|
| 2 166 865 | 5/1986 | United Kingdom . |
| 2 238 325 | 5/1991 | United Kingdom . |

*Primary Examiner*—M. Rachuba
*Assistant Examiner*—Sean A. Pryor
*Attorney, Agent, or Firm*—Venable; Gabor J. Kelemen

[57] ABSTRACT

An apparatus for severing fiber bale ties and removing cut ties from a fiber bale includes a tie cutter for severing a metal tie surrounding the bale at a bale location; and a first metal sensor for responding to a presence of a metal tie around the bale. The first metal sensor is situated ahead of the tie cutter, whereby the first metal sensor passes by the bale tie prior to being severed by the tie cutter. There is further provided a second metal sensor for responding to a presence of a metal tie in engagement with the bale. The second metal sensor is situated after the tie cutter, whereby the second metal sensor trails the tie cutter relative to the fiber bale. The apparatus further has a device for displacing the bale and the first and second metal sensors relative to one another.

8 Claims, 5 Drawing Sheets

APPARATUS FOR DETECTING METAL TIES IN FIBER BALES

CROSS REFERENCE TO RELATED APPLICATION

This application claims the priority of German Application No. 195 20 247.3 filed Jun. 2, 1995, which is incorporated herein by reference.

BACKGROUND OF THE INVENTION

This invention relates to an apparatus for detecting metal ties such as wires, straps or the like used for textile fiber bales. The apparatus includes a metal detector which operates without mechanical contacting and which is oriented towards a surface of the textile fiber bale. The metal detector and the fiber bale are relatively movable with respect to one another, and the metal ties are removed from the fiber bale after severance and before the fiber bale is processed.

SUMMARY OF THE INVENTION

It is an object of the invention to provide an improved apparatus of the above-outlined type which makes possible an automatic detection of metal ties which have not been removed after the cutting and removing process.

This object and others to become apparent as the specification progresses, are accomplished by the invention, according to which, briefly stated, the apparatus for severing fiber bale ties and removing cut ties from a fiber bale includes a tie cutter for severing a metal tie surrounding the bale at a bale location; and a first metal sensor for responding to a presence of a metal tie around the bale. The first metal sensor is situated ahead of the tie cutter, whereby the first metal sensor passes by the bale tie prior to being severed by the tie cutter. There is further provided a second metal sensor for responding to a presence of a metal tie in engagement with the bale. The second metal sensor is situated after the tie cutter, whereby the second metal sensor trails the tie cutter relative to the fiber bale. The apparatus further has a device for displacing the bale and the first and second metal sensors relative to one another.

Thus, according to the invention, the metal ties detected by the first metal detector are automatically severed by a cutter and are subsequently removed. The second metal detector automatically detects metal ties (or parts thereof) which were not fully severed or not cut at all by the tie cutter and thus have not yet been removed. In this manner fiber bales carrying residual bale ties or parts thereof can be reliably identified and the residual ties may be removed prior to the subsequent processing of the fiber bale. Further, the invention prevents fiber bales from being admitted to a subsequent machine, such a bale opener. This means that such subsequent machines are protected from damage, and an automatic operation is possible starting from the bale supply effected by the bale preparing apparatus up to the bale opener.

DESCRIPTION OF THE PREFERRED EMBODIMENT

Figure 1:
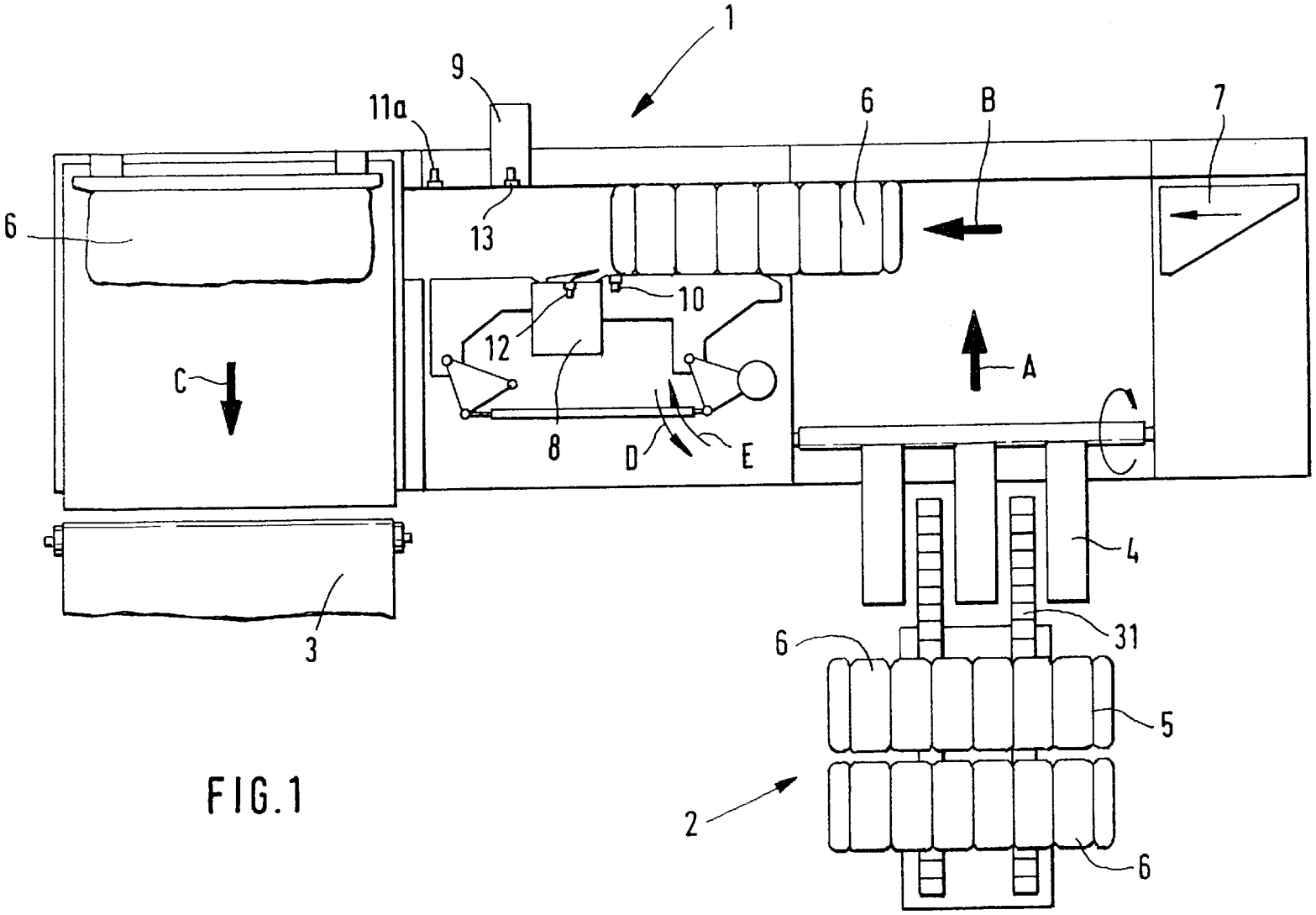
FIG. 1 is a schematic top plan view of the apparatus according to the invention, situated between a bale supplying device and a bale removing device.

Turning to FIG. 1, the apparatus according to the invention is positioned between a bale supplying apparatus 2 and a bale removing apparatus 3. The bale supplying apparatus 2 includes a chain conveyor 31 and a bale hoisting pivotal fork 4 supported in a rotary bearing not shown. The bale ties 5 usually consist of narrow steel bands or wires. Prior to processing the fiber bale 6, for example, by means of a non-illustrated bale opener, the ties 5 which circle the highly-compressed fiber bale, have to be removed. For this purpose, the bale 6 is admitted in the direction A to a bale preparing apparatus 1 and is moved by a pusher element 7 in the direction B against a tie cutter 8 and is also moved past a tie removing device 9 for removing the severed ties 5 from the fiber bale. Thereafter the bale 6 is advanced in the direction C and is admitted to the bale removing apparatus 3 which may be an endless conveyor, a bale carriage or the like which transports the bale to a non-illustrated bale opener which may be a BLENDOMAT BDT model, manufactured by Trützschler GmbH & Co. KG, M önchengladbach, Germany.

Figure 2A:
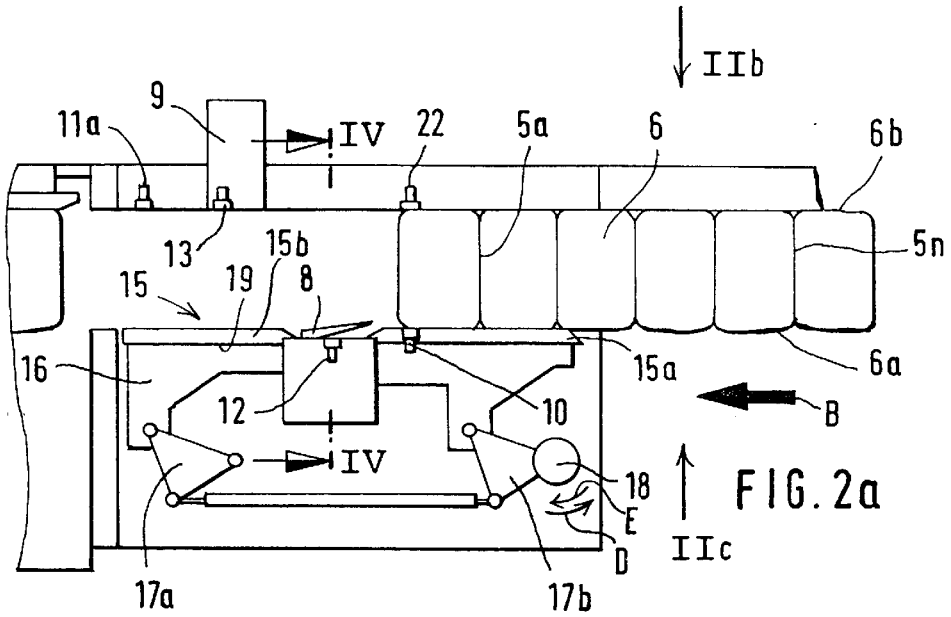
FIG. 2*a* is a schematic top plan view of a part of a preferred embodiment of the invention operating with four metal sensors.
Figure 5:
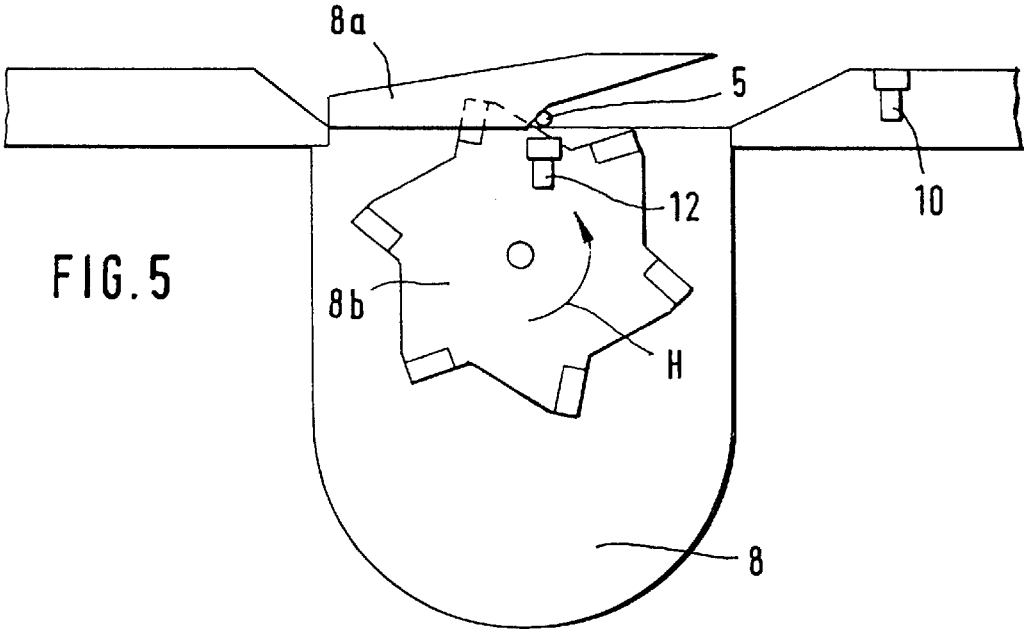
FIG. 5 is a schematic side elevational view of a tie cutter forming part of the apparatus according to the invention.

Also referring to FIGS. 2*a,* 2*b* and 2*c,* an inductive proximity sensor 10, operating as a contactless metal detector, is oriented towards a side face 6*a* of the fiber bale 6. The metal sensor 10 is situated upstream of the tie cutter 8 as viewed in the direction of fiber bale advance and serves for detecting (recognizing) metal bale ties 5*a*–5*n.* Two additional, second inductive proximity sensors 11*a* and 11*b* operating as contactless metal detectors are provided which are oriented towards the side face 6*b* of the fiber bale 6. The two sensors 11*a* and 11*b* are at a vertical distance a from one another and are situated downstream of the tie cutter 8 and the tie removing device 9. The sensors 11*a,* 11*b* serve for detecting those bale ties or tie parts 5*a*–5*n* which were not severed and/or removed by the tie cutter 8 and/or the tie removing device 9. The sensors 11*a,* 11*b* are connected with a signalling device 11*c* to indicate the presence of a tie or tie parts detected by the sensor 11*a* and/or 11*b.* As an alternative, or in addition, the sensors 11*a,* 11*b* are connected to a fiber bale removing device which, when the sensors 11*a* and/or 11*b* detect the presence of a tie or tie parts in the bale, prevents the bale from being admitted to the conveyor 3, and, for example, directs the bale to a location where the residual ties or tie parts are removed. There is further provided a third metal detector 12 which is also an inductive proximity sensor and which is oriented towards the tie cutter 8, as shown in FIG. 5. The sensor 12 determines the presence and position of a bale tie 5*a*–5*n* in the tie cutter 8. Further, a fourth metal detector 13 is provided which is also an inductive proximity sensor 13 and which is associated with the tie removing device 9. The sensor 13 responds to the presence and position of a bale tie 5*a*–5*n* in the tie removing device 9.

Figure 2B:
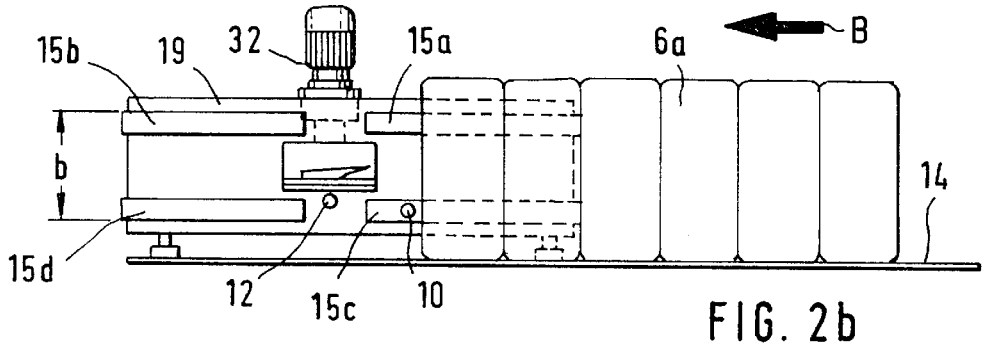
FIG. 2*b* is a schematic side elevational view of the construction shown in FIG. 2*a,* as seen in the direction of the arrow IIb in FIG. 2*a.*
Figure 2C:
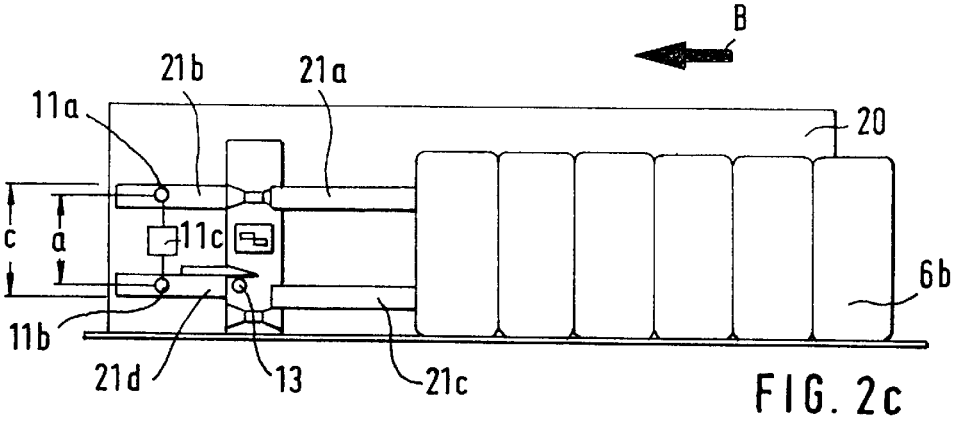
FIG. 2*c* is a schematic side elevational view of the construction shown in FIG. 2*a,* as seen in the direction of the arrow IIc in FIG. 2*a.*

The tie cutter 8 and a pressing device generally designated at 15 are, as shown in FIG. 2*a,* mounted on a common holding device 16 which is pivotally held by two levers 17*a,* 17*b* supported for rotation about a stationary rotary bearing 18 driven by a motor 29 for counterclockwise and clockwise pivotal motions as indicated by respective arrows D and E. The pressing device 15, as shown in FIG. 2*b,* is formed of four bars 15*a,* 15*b,* 15*c* and 15*d* arranged on a surface 19 of the holding device 16. The bar 15*a* is in a longitudinal alignment with the bar 15*b* and the bar 15*c* is in a longitudinal alignment with the bar 15*d*. Further, the bars 15*b,* 15*b* are parallel to the bars 15*c,* 15*d* and are arranged thereabove at a distance b. The tie removing device 9 is secured in a stationary surface 20 which also supports longitudinally arranged bars 21*a,* 21*b,* 21*c* and 21*d*. The bars 21*a* and 21*b* are positioned above bars 21*c* and 21*d* at a distance c therefrom.

Figure 3A:
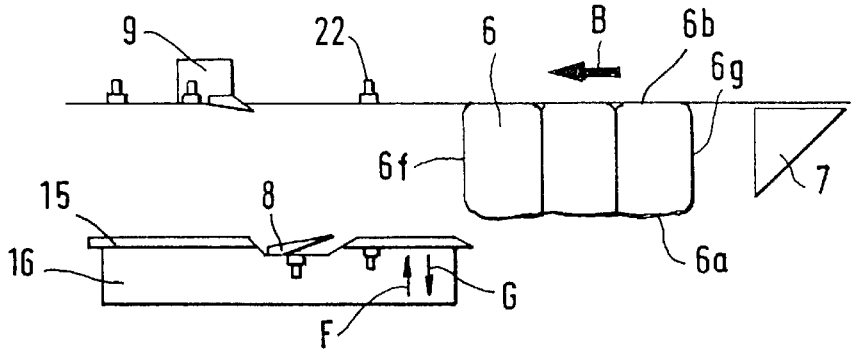
FIGS. 3*a*–3*e* are schematic side elevational views of different, subsequent operational phases performed by the apparatus according to the invention.
Figure 3B:
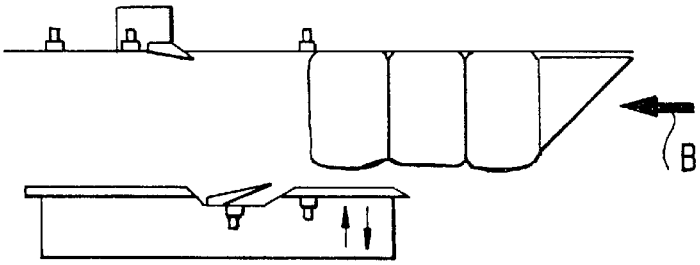
Figure 3C:
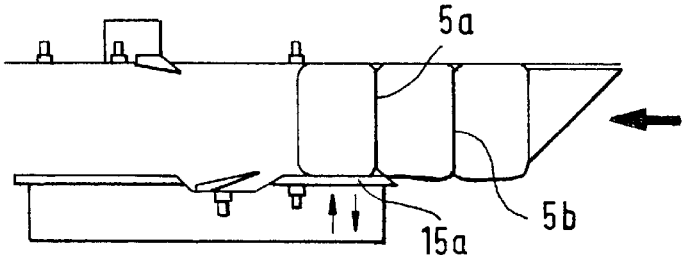
Figure 3D:
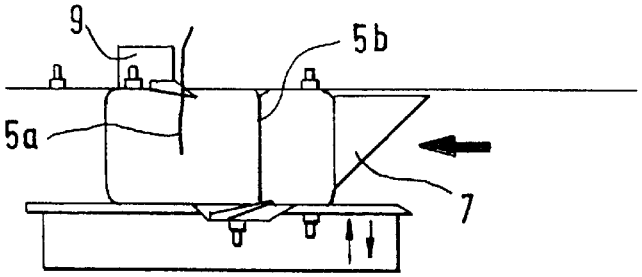
Figure 3E:
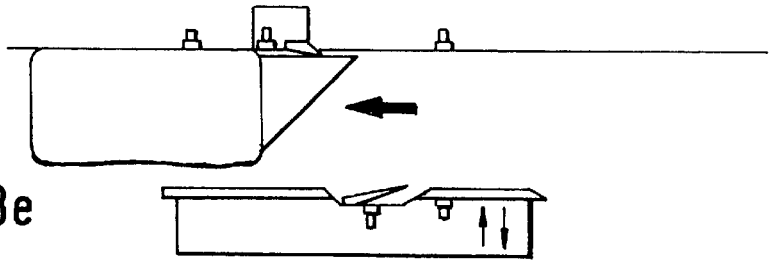

The fiber bale 6 is positioned on a smooth slide plate 14. In operation the bale 6 is, as shown in FIG. 3*a,* pushed from its initial position by the driven pusher element 7 in the direction of the arrow B up to an optical barrier 22 into the position as shown in FIG. 3*b*. The optical barrier 22 is situated upstream of the tie cutter 8 as viewed in the direction B. Subsequently, the holding device 16, together with the tie cutter 8 and the pressing device 15 is pivoted in the direction of the arrow F until the bars 15*a* and 15*c* of the holding device 16 firmly engage the side 6*a* of the bale 6, as shown in FIG. 3*c*. Thereafter the fiber bale 6 is pushed in the direction B as shown in FIG. 3*d* by the pusher 7 as the bale ties 5*a*–5*n* are in sequence severed by the tie cutter 8. Thereafter, as shown in FIG. 3*d,* the fiber bale 6 is pushed along the tie removing device 9 which pulls away the severed ties 5*a*–5*n* from the bale 6. Subsequently, the holding device 16 is pivoted back into its position in the direction of the arrow G as shown in FIG. 3*e*.

Figure 4:
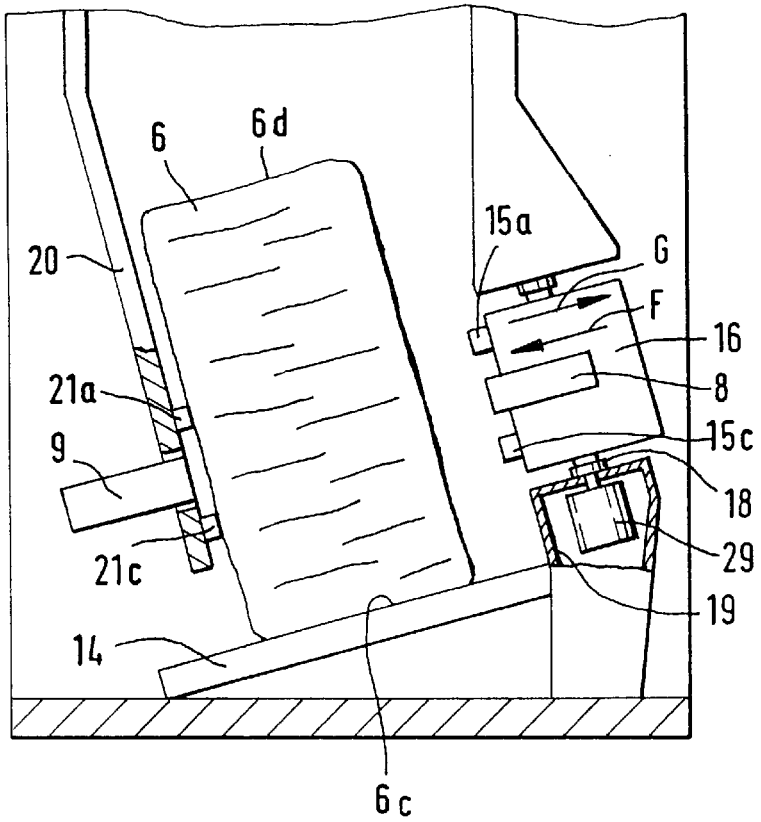
FIG. 4 is a sectional view taken along line IV—IV of FIG. 2*a.*

Turning to FIG. 4, the fiber bale 6 is situated in a slightly oblique orientation and leans against the bars 21*a* and 21*c* carried by the surface 20, while its bottom face 6*c* rests on the slide plate 14. The surfaces 19 and 20 leave openings for the tie cutter 8 and the tie removing device 9. A motor 29 drives the holding element 16 to execute its pivotal motion with the tie cutter 8 and the pressing device 15.

As shown in FIG. 5, the tie cutter 8 comprises a spike 8*a* and a star-shaped cutter wheel 8*b* which is slowly rotated in the direction of the arrow H by a motor 32 as shown in FIG. 2*b*. The spike 8*a* is pushed through the side face 6*a* of the fiber bale 6 and underneath the bale tie 5 which is thus lifted off the side face 6*a* and placed between two points of the star-shaped cutter wheel 8*b*. As the cutter wheel 8*b* rotates, the bale tie 5 is severed while it is wedged against the cutter wheel 8*b*. Underneath the cutter wheel 8*b* the sensor 12 is oriented towards the spike 8*a* to determine whether a bale tie 5 is present, while the sensor 10 is situated upstream of the tie cutter 8.

Figure 6:
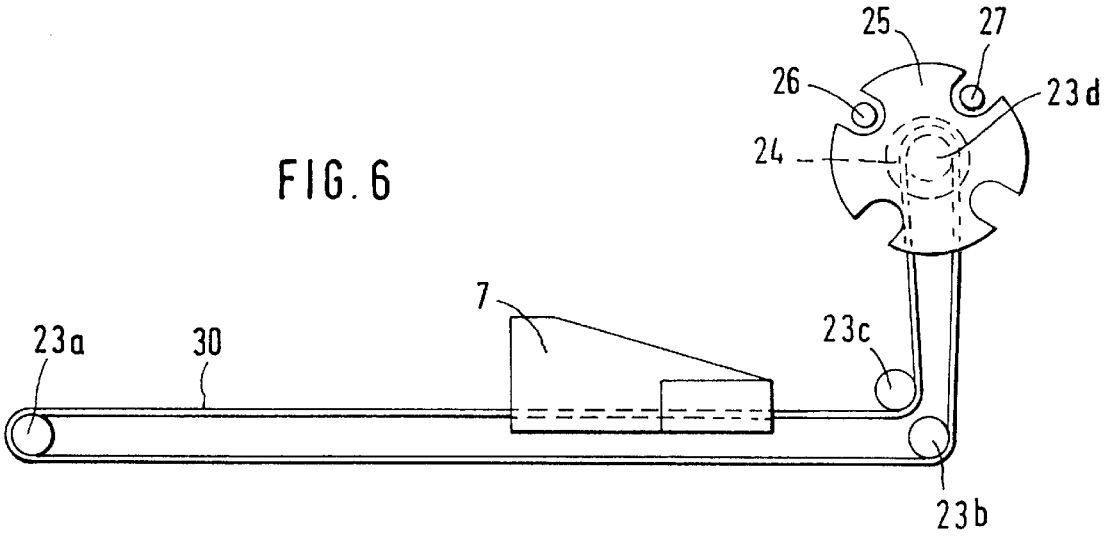
FIG. 6 is a schematic side elevational view of a driving device for a bale shifting element forming part of the apparatus according to the invention.

As shown in FIG. 6, the pusher element 7 is secured to an endless belt or chain 30 which is trained about rollers 23*a,* 23*b,* 23*c* and 23*d*. The roller 23*d* is driven by an electric motor 24 and carries a counting disk 25 associated with two inductive path sensors 26 and 27 for forward and rearward run. The counting device 25, 26, 27 measures the path travelled by the pusher element 7 and emits signals used for controlling a corresponding motion process for the bale 6.

Figure 7:
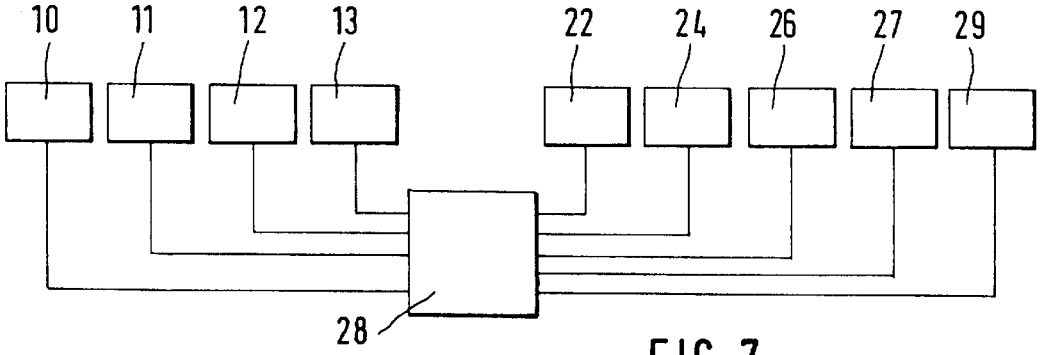
FIG. 7 is a block diagram illustrating the electronic control of the apparatus according to the invention.

As shown in FIG. 7, an electronic control and regulating device 28, for example, a microcomputer is provided to which the first proximity sensor 10, the second proximity sensors 11*a,* 11*b,* the third proximity sensor 12, the fourth proximity sensor 13, the optical barrier 22, the drive motor 24 for the pusher element 7, the drive motor 29 for the holding device 16 as well as the proximity sensors 26 and 27 are attached.

It will be understood that the above description of the present invention is susceptible to various modifications, changes and adaptations, and the same are intended to be comprehended within the meaning and range of equivalents of the appended claims.

What is claimed is:

1. An apparatus for severing fiber bale ties and removing cut ties from a fiber bale, comprising (a) bale advancing means for moving a fiber bale in an advancing direction along a travel path;

(b) a first metal sensor supported at a location along said travel path for responding to a presence of a metal tie around the bale;

(c) a tie cutter supported at a location along said travel path for severing a metal tie surrounding the bale at a bale location; said tie cutter being situated downstream of said first metal sensor as viewed in said advancing direction, whereby said first metal sensor passes by said location prior to said tie cutter;

(d) a tie removing device situated downstream of said tie cutter for pulling ties severed by said tie cutter away from the bale;

(e) a second metal sensor supported at a location along said travel path downstream of said tie removing device for responding to a presence of a metal tie unremoved by said tie removing device.

2. The apparatus as defined in claim 1, further comprising a signalling device connected to said second metal sensor for indicating presence of a metal tie detected by second metal sensor.

3. The apparatus as defined in claim 1, wherein said second metal sensor comprises two vertically-spaced sensor elements.

4. The apparatus as defined in claim 1, further comprising a moving device; said moving device including (a) a holder carrying said tie cutter and said first metal sensor;

(b) means for supporting said holder for displacements of said holder transversely to said travel path; and (c) motor means for displacing said holder transversely to said travel path.

5. The apparatus as defined in claim 1, further comprising an electronic control and regulating device, a first driving device forming part of said bale advancing means, and a second driving device for said tie cutter; said first metal sensor, said second metal sensor, said first driving device and said second driving device being connected to said electronic control and regulating device.

6. The apparatus as defined in claim 1, further comprising a third metal sensor arranged adjacent said tie cutter for detecting metal ties therein.

7. The apparatus as defined in claim 1, further comprising a fourth metal sensor arranged adjacent said tie removing device for detecting metal ties therein.

8. The apparatus as defined in claim 1, further comprising moving means for displacing said tie cutter and said first metal sensor together, transversely to said travel path.

* * * * *